United States Patent [19]

Ikeda et al.

[11] 4,361,319

[45] Nov. 30, 1982

[54] BIN FOR RECEIVING SHEETS

[75] Inventors: Sunao Ikeda, Yokohama; Tamaki Kaneko, Fujisawa; Kunio Hibi, Yokohama; Tugio Okuzawa, Tokyo; Yohtaro Kakitani; Hideo Kikuchi, both of Yokohama, all of Japan

[73] Assignee: Ricoh Co., Ltd., Japan

[21] Appl. No.: 188,723

[22] Filed: Sep. 19, 1980

[30] Foreign Application Priority Data

Sep. 29, 1979 [JP] Japan ..... 54-134811[U]

[51] Int. Cl.[3] ..... B65H 31/00

[52] U.S. Cl. ..... 271/209

[58] Field of Search ..... 271/207, 208, 209

[56] References Cited

U.S. PATENT DOCUMENTS 3,807,726 4/1974 Hope ..... 271/207

3,957,264 5/1976 Bach ..... 271/208 X 3,988,018 10/1976 Tusso ..... 271/208 X

*Primary Examiner*—Richard A. Schacher

*Attorney, Agent, or Firm*—McGlew and Tuttle

[57] ABSTRACT

A bin for receiving sheets arranged in an apparatus for collating or sorting of sheets fed successively, which includes a rear end portion, a front end portion and an intermediate inclination portion connected therebetween. The front end portion includes a stopper or stoppers extending substantially vertical for stopping a front end of the sheet fed into the bin and a straight guide portion, on which the stopper or stoppers attached. The rear end portion includes an upright plate extending substantially vertical used for stopping and aligning a rear end of the sheet and a plate inclined so as to go down forwards in sheet feeding direction. The intermediate inclination portion is connected at front and rear end with the straight guide plate and the inclined plate of the rear end portion direct or through curve portion. In this bin the sheet can be aligned by using falling motion of the sheet with the own weight.

4 Claims, 3 Drawing Figures

1
2
3
4
5
6
7
8
9
10
11
12
13
14
15
16
17
18
19
20
21
22
23
26
S1
S2
S
T
R1
R2
α
β
ℓ1
ℓ

BIN FOR RECEIVING SHEETS

FIELD AND BACKGROUND OF THE INVENTION

This invention relates to an improvement for a bin which is arranged in an apparatus such as a collator which has a number of bins for receiving collated or sorted sheets.

The sheet fed from a printing machine or a copying machine to the collator and so on usually has a curling. For example, a copy sheet such as PPC paper used for the copying machine is curled by passing through a fixing station. The curling of the copy sheet arises in many cases at corners thereof and then arises at a front edge and a rear edge thereof.

When many curled sheets are received and piled in the bin, a front edge of a succeeding sheet thrust against a rear curled edge of the preceding sheet, so that the succeeding sheet cannot be fed smoothly on the preceding sheet, and there is the possibility that the sheet is received in the rear part of the bin in a curled condition. By repeating of this situation, some of the sheets received in the bin are rolled by curling and other sheets are turned over, so that there is a disadvantage such that the front edges of the sheets can not be aligned.

To eleminate this disadvantage it has been provided that the bottom plate of the bin is formed in a concave shape with a larger curvature than that of the curling of the sheets. This bin is available for receiving a large-sized sheet, but it is not available for receiving a small-sized sheet because the receiving of the sheet of small size results in the same condition as in the former case. Therefore a good stack condition of the sheet cannot be obtained. As the curvature of the bottom plate is large, a large space is further required for the bin.

SUMMARY OF THE INVENTION

The object of the present invention is to provide a bin, in which the front edges of the stacked sheets can be aligned independently of the size of the sheets, and also the sheets having a curl can be received while being aligned at front edges thereof.

The object of the present invention is further to provide a bin capable of receiving a great many sheets (more than 100 pieces).

Other objects, features and advantages of the invention will be apparent from the following detailed description appended claims, and the accompanying drawings.

DETAILED DESCRIPTION OF THE PREFERRED EMBODIMENT

Figure 1:
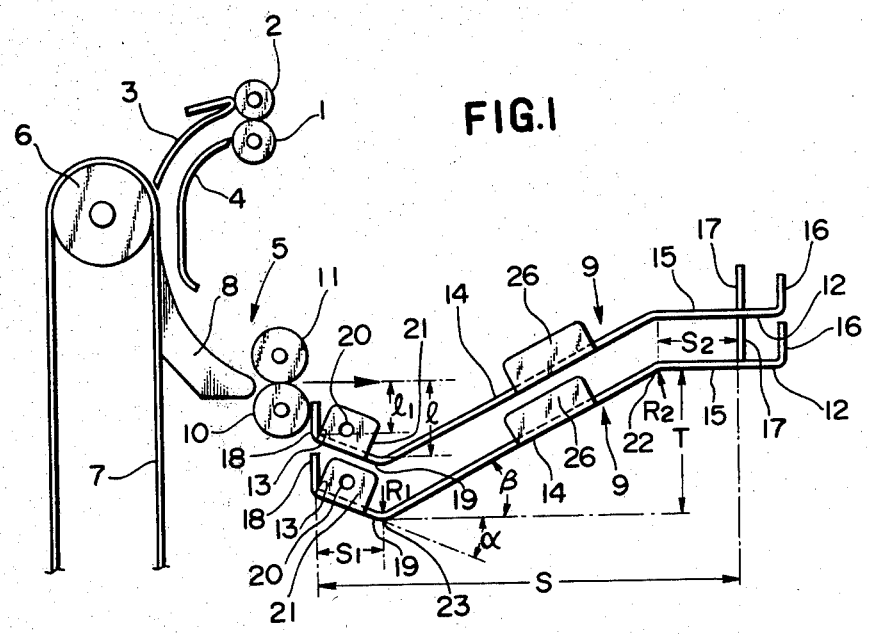
FIG. 1 is a schama explaining a main part of the apparatus having a bin.

Referring to the drawings, and in particular to FIG. 1 a sheet such as a copy sheet is fed from the copying machine and so on to an apparatus for collating or sorting, and it is laterally fed in the apparatus by the known means for arranging the side edge in predetermined position. Then the sheet is fed by an intermediate roller device having a driving roller 1 and a press roller 2 and guided through guide plates 3 and 4 to a deflecting device 5.

The deflecting device includes separating pawl 8 being moved up- and downwardly by a belt 8 which is stretched around belt wheels 6 and a discharging roller 10 for discharging a sheet deflected by the separating pawl 8 into a suitable bin selected from the bins 9 which are arranged with a suitable interval in the vertical direction. The discharging roller 10 is moved up and down together with the separating pawl 8 and it is provided with a press roller 11 for pressing the sheet to the discharging roller 10.

When the feeding speed of the discharging roller 10 is selected to be faster than that of the intermediate roller device, for example 1000 mm/sec, the sheet can be desirably stacked in the bin.

Figure 2:
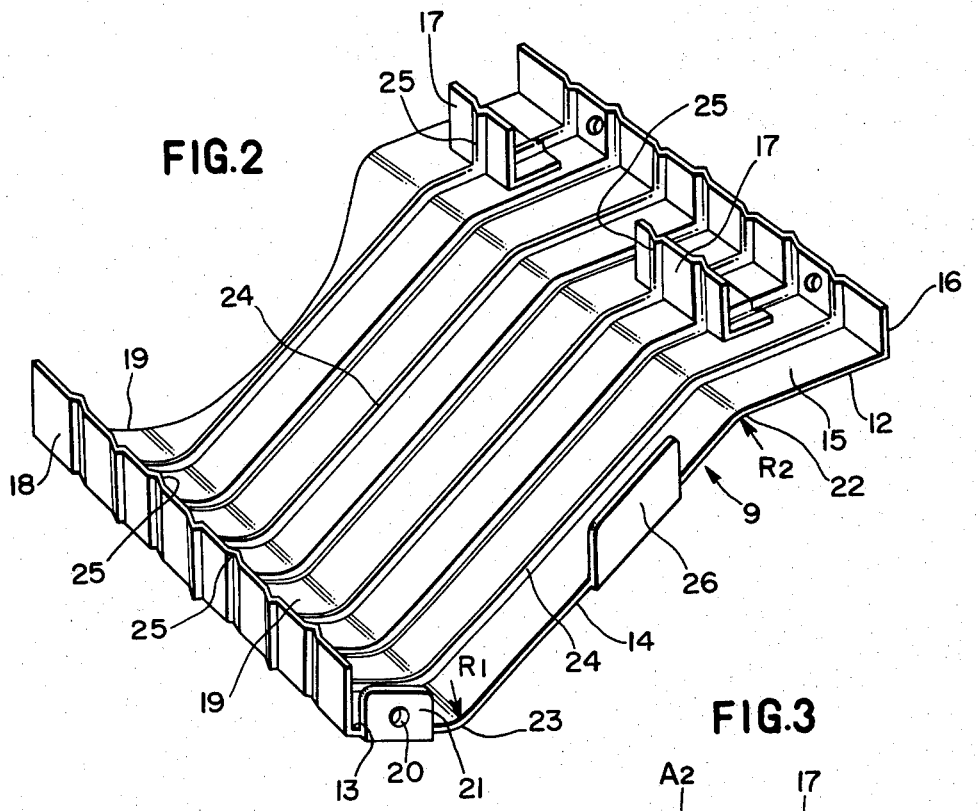
FIG. 2 is a perspective view of the bin of the present invention.

Each bin has a front end part 12 which is positioned higher than a level of the sheet when it is discharged in a substantially horizontal direction, from the discharging roller 10 in corresponding position, a rear end part 13 being positioned lower than the said level and an intermediate inclination part 14 connecting the front end part 12 to the rear end part 13 as shown in FIG. 2.

The front end part 12 includes a straight guide portion 15 and a vertical wall 16 providing an attaching plane for mounting.

On the straight guide portion 15 a stopper 17 for stopping the sheet is attached. The front end of the sheet fed from the discharging roller 10 runs against the stopper 17 and stops. It is preferable, for stopping sheets of every size that are received in the bin without skewing, to dispose at least two stoppers 17 at a suitable distance. Instead of the two stoppers only one stopper having an available length can be used.

The rear end portion 13 has an upright plane 18 used to align the rear edges of the sheets received in the bin 9 and an inclined plate 19 being slightly inclined so as to extend downwardly in the forward direction or away from the discharging roller 10. The inclined plate 19 can be provided with a flat surface or a concave surface. The inclined plate 19 is provided on both sides thereof with a lug 21 having a hole 20 used for mounting the bin 9 to a machine frame. The lug 21 can be formed on both sides of the intermediate inclination part 14 instead of the inclined plate 19. At side ends of the intermediate inclination part 14 is formed stoppers 26 for preventing a deviation of the sheets.

The straight guide portion 15 of the front end part 12 is connected with the intermediate inclination part 14 smoothly through a front curved portion 22 with a radius $R_2$. The inclined plane 19 of the rear end part 13 is connected with the intermediate inclination part 14, smoothly through a rear curved portion 23 with a radius $R_1$.

The inclined plane 19 has an inclination angle to a horizontal plane designated with $\alpha$. The intermediate inclination part 14 has an inclination angle to the horizontal plane designated with $\beta$. In FIG. 1 a height from a lowest point of the rear curve portion 23 forming a transfer portion between the rear end portion 13 and the intermediate inclination part 14 to the straight guide portion 15 is designated with T. A height from a lowest position of the rear curve portion 23 to the discharging level of the discharging roller 10 is designated with l. A height from a highest position of the inclined plane 19, or a connecting position between the upright plane 18 and the inclined plane 19 to a sheet discharging level of the discharging roller 10 is designated with $l_1$.

Figure 3:
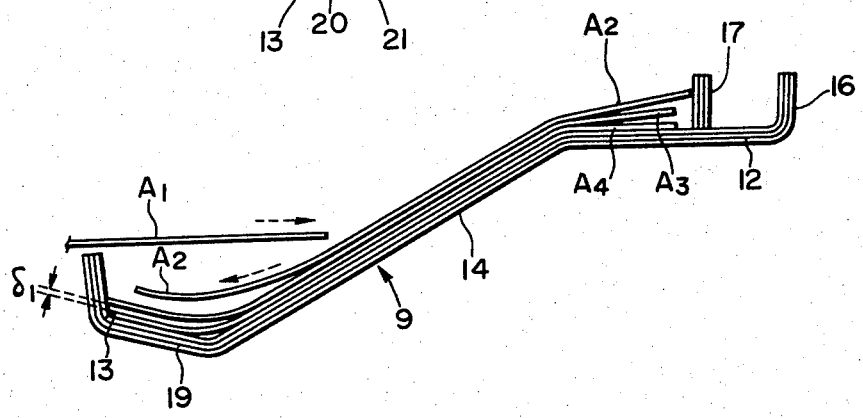
FIG. 3 is an explaining view of the receiving state of the sheet.

The sheet is fed from the discharging roller 10 in a state A shown in FIG. 3, then it ascends through the intermediate inclination part 14 and stops by contacting with the stopper 17 in a state $A_2$. The sheet falls by its own weight along the guide surface of the intermediate inclination part 14 after stopping. The inclination angle $\beta$ of the intermediate inclination part 14 is so selected that the weight of the sheet overcomes a friction and the sheet can slide down. The rear end of the sheet ascends along the inclined plane 19 some distance after sliding down and stops by contacting the upright plane 18 in a state $A_3$ in FIG. 3.

The sheet received in the state $A_3$ may form a space $\delta_1$ between the rear end thereof and the surface of the inclined plate 19 or the sheet received previously because of the curling of the sheet. The extent of the curling of the sheet is reduced by a falling of the temperature of the sheet from the temperature on the fixing station, so that the space $\delta_1$ can be reduced to zero and the sheet can be stacked tightly on the preceding sheet.

By selecting the inclination angle $\alpha$ on about 10°, the sheet with a slight curl can hold the space $\delta_1$ to zero, so that more than 100 sheets can be brought at their rear end to contact with the upright 18. Therefore they can be stacked tightly with each other.

When the inclination angle $\alpha$ is selected to be 0°, it was ascertained by our experience that a limit of sheets in a preferable stack was in the range between 20 to 50 pieces. If more than 50 sheets are stacked, the succeeding sheet pushes at its front end against the curled rear end of the preceding sheet and there is a possibility of disturbing of the order of the stacked sheets.

And further it was ascertained by our experience that the rear end of each sheet can be preferably aligned in a range 25°–30° of the inclination angle of the intermediate inclination part 14.

The height $l_1$ of the rear end portion 13 is decided on the basis of the number of sheets to be stacked, the degree of curling of the sheets and the thickness of the sheets. By selecting the height to be $l_1$ in 19–20 mm, 100 pieces can be stacked. For a length in the horizontal direction between the upright 18 of the rear end portion 13 and the stopper 17 of the front end portion 12 it is preferable to select the length of the sheet to be stacked plus about 10 mm. In this case we had good results with sheets of B-4 size. The shorter a length $S_2$ of the straight guide portion 15 of the front end portion 12 is selected the better stack effect can be obtained, but the limit range of length $S_2$ is 60–70 mm and it was ascertained by the experience that a bad influence of curling is caused by selecting the length $S_2$ more than this limit range.

A length $S_1$ in the horizontal direction of the inclined plane 19 of the rear end portion 13 is selected on the basis of the degree of the curling of the sheets, and in this case the relation to the inclination angle $\alpha$ is to be considered.

The height l and T are decided naturally by selecting the values of $l_1$, $\alpha_1$, $S_1$, $S_2$, S and $\beta$.

When the radius $R_2$ of the front curve portion 22 is selected to be a sufficiently large value, the sheets can be stacked tightly as shown at $A_4$ in FIG. 3, but the front end portion of the sheets curled to a high degree, at keep at a distance from the preceding sheet as shown with $A_3$. When the distance from the preceding sheet is smaller than the height of the stopper 17, there will be no problem. For receiving the sheet in the bin 9 in condition of fitting with the shape of the bin, it is preferable for the radius R, to be selected as large as possible.

On the straight guide portion 19, the front curve portion 22, the intermediate inclination part 14, the rear curve portion 23 and the inclined plane 19 of the bin 9 a number of convex ribs 24 are provided for reducing the contact area of the bin with the sheet so as to reduce the friction resistance between the sheet and the bin. Therefore a slippery surface of the bin can be obtained and the preferable stacking of the sheet can be carried out.

By providing ribs 25 on the upright plane 18 and on the stopper 17, air can be easily ejected on the occasion of stacking of the sheets, so that the space $\delta_1$ between the sheets becomes zero quickly and the sheets move close together quickly. This eliminates disadvantages in feeding of the next sheet and the number of sheets than can be stacked can be increased.

For providing a ribs 24, 25, the convex rib can be formed on the both sides of the plate for reinforcing the bin.

On the occasion of receiving a sheet which is sized smaller than the predetermined size, a front end of any sheets cannot be brought into contact with the stopper 17. In this case the sheet falls along its surface of the bin with the own weight and the rear end of the sheet comes into contact with the upright plane 18 and can be aligned accurately.

In the present invention it can be accomplished that the rear end (not a rear end in the printed situation, but in direction of feeding by the discharging roller) of the sheet can be aligned accurately irrespective of the sheet size. And further many sheets more than 100 pieces can be aligned at their one end, namely at the front end or the rear end, and stacked accurately irrespective of the existence of curling. Therefore sheets fed with a speed more than 400 mm/sec. can be stacked accurately.

What is claimed is:

1. A bin for receiving sheets arranged in an apparatus for collating or sorting of sheets fed successively, including a rear end portion having a plate extending substantially vertically for forming an aligning face of sheet-ends and an inclined plate extending downwardly, forwardly in a feeding direction of sheet, a front end portion with a stopper or stoppers, and an intermediate inclination portion for smoothly connecting the front end portion with a rear end portion which extends upwardly, forwardly in the feeding direction of sheet, said front end portion including a straight guide portion extending substantially horizontally for connecting with said intermediate inclination portion.

2. A bin as set forth in claim 1, wherein said front end portion, said intermediate inclination portion and said rear end portion include respectively a guide plane with convex ribs.

3. A bin as set forth in claim 2, wherein said guide plane has convex ribs on both sides.

4. A bin for receiving sheets in a collator or sorter having means for feeding sheets at a selected level in a feed direction comprising:

a substantially vertical rear end plate positioned below said level for forming an aligning face of sheet-ends;

a first inclined plate connected to a lower edge of said rear end plate and inclined downwardly from said rear end plate at an acute angle to the horizontal and extending downstream of the feed direction;

a second inclined plate connected to a lower edge of said first inclined plate and extending at an acute angle to the horizontal upwardly of said first inclined plate to a level above said selected level, said second inclined plate having a length greater than said first inclined plate in the feed direction; and at least one stop at a downstream end of said second inclined plate in the feed direction for stopping front edges of sheets fed by said means for feeding sheets;

connections between said rear end, first inclined and second inclined plates being smooth whereby sheets fed by said means for feeding sheets feed each sheet against said second inclined plate and up said second inclined plate to a level above said second inclined plate so that by the weight of each sheet, each sheet descends along said second inclined plate and up said first inclined plate until it abuts said substantially vertical rear end plate, said acute angle from a horizontal of said second inclined plate being chosen to be sufficient so that the weight of each sheet produces a downward force on said second inclined plate greater than the frictional force between sheets to be stacked and between a first sheet to be stacked and said second inclined plate.

* * * * *